United States Patent [19]

Royer, II

[11] Patent Number: 4,590,750

[45] Date of Patent: May 27, 1986

[54] SADDLE STIRRUP SETTING DEVICE

[76] Inventor: Clady J. Royer, II, 2808 Meridian Ct., Oklahoma City, Okla. 73127

[21] Appl. No.: 607,228

[22] Filed: May 4, 1984

[51] Int. Cl.[4] ..... B68C 3/00

[52] U.S. Cl. ..... 54/46; 119/128; 54/1

[58] Field of Search ..... 119/126, 127, 128, 152; 54/1, 46, 47; 128/133

[56] References Cited

U.S. PATENT DOCUMENTS 388,737 8/1888 Spieth ..... 119/128

647,735 4/1900 Widmayer ..... 119/126 X 1,803,048 4/1931 Allen ..... 119/128

4,321,890 3/1982 Lange et al. ..... 128/133 X

*Primary Examiner*—Robert P. Swiatek

*Attorney, Agent, or Firm*—William R. Laney

[57] ABSTRACT

A device for imparting a set to the stirrups of a saddle to orient them in a riding status to receive the boots of a mounted rider, the device including a pair of open-sided stirrup engaging elements secured to opposite ends of an elongated rod. The stirrup engaging elements include a bight or web portion which is laterally offset from the axis of the rod by a distance which is approximately the width of a saddle stirrup.

4 Claims, 3 Drawing Figures

SADDLE STIRRUP SETTING DEVICE

FIELD OF THE INVENTION

This invention relates to tack equipment, and more particularly, to a device for imparting a set to the stirrup straps of a saddle so as to support the stirrups in a position in which they are oriented to receive the boots of a mounted rider.

BRIEF DESCRIPTION OF THE PRIOR ART

In present day equestrian saddle construction, the saddle stirrups have been attached to the stirrup leathers (the straps by which the stirrups are suspended) by using a bolt or rod which is extended through loops at the end of the stirrup leathers and through opposite sides of the generally U-shaped stirrup. As manufactured, the described construction causes the stirrups to extend substantially parallel to the horse, making it difficult for the rider to place his foot into the stirrups when mounting, and also making it difficult to retrieve a stirrup when it is lost by the rider during riding.

Several proposals have been advanced, and some of them patented, for correcting the propensity of the stirrups to hang parallel to the sides of the horse, thereby making it difficult for the rider to insert his foot into the stirrup when riding and to "keep" the stirrups when riding. One of these is a swivel attachment described in U.S. Pat. No. 2,532,082, which attachment swively supports the stirrup at the lower end of the stirrup leather, thus permitting it to be turned to a proper orientation without the necessity to twist the stirrup leathers and thus place a torquing force on the stirrup leather and its suspended stirrup tending to return it to the unsatisfactory position in which the stirrup extends parallel to the horse.

Another proposal to overcome the normal attitude of the stirrup in which it extends with its opening parallel to the horse's body is that which is shown and described in U.S. Pat. No. 2,978,855. In accordance with the patent, a special member having a twisted or angulated configuration is inserted between the stirrup and the stirrup leather so that by attaching the stirrup to the lower end of the special member, it is positioned at right angles to the body of the horse, and thus has its opening facing the rider and accessible to the toe of the riding boot or foot of the rider.

U.S. Pat. No. 3,827,215 to Edenfield proposes to use an accessory to assist a rider in getting his foot into a stirrup when mounting the horse. This accessory comprises a pair of straight handles which are positioned adjacent each other and which cooperate to twist the stirrup leather into a position such that the stirrups are oriented substantially in a plane which extends perpendicular to the fore and aft axis of the saddle. The device shown in this patent is used after wetting the stirrup leathers and holds the stirrup leathers in the twisted status necessary for proper orientation of the stirrups until the leather has dried and assumed a set in the desired twisted configuration.

U.S. Pat. No. 4,354,338 discloses another fender bending attachment which includes a pair of legs oriented at right angles to each other and used to engage a fender so that the fender is actually bent into an angular shape in which one part of the fender extends at 90° to a second part of the fender. By attaching the stirrup to that part of the fender which extends at 90° to the body of the horse, the stirrup is caused to be oriented in the proper position to permit the rider to place his foot in the stirrup when mounting and demounting without the necessity of probing or failing to quickly and firmly engage the stirrup.

The described devices do not solve the problem of optimum stirrup attitude of position without attendant difficulties and disadvantages. For example, any device which relies upon the fender or stirrup leather being wetted has the disadvantage of accelerating deterioration of the leather by reason of such soaking or wetting, and further results in unsightly staining of the leather. Moreover, some types of devices, such as that shown in U.S. Pat. No. 4,354,338, require the attachment of an extra device to the saddle fender, increasing the overall weight of the saddle and providing an object which may strike the side of the horse during riding, and may further be an impediment to the rider by contact with the leg of the rider.

BRIEF DESCRIPTION OF THE PRESENT INVENTION

This invention relates to a device which can be utilized to impart a set to the straps which suspend the stirrups of an equestrian saddle so that the stirrups will be positioned to extend approximately in a plane which passes normal to the fore and aft access of the saddle. The stirrups are thereby presented in a readily accessible and open position to receive the boots of the rider. The device thus enables the saddle to be modified from its normally manufactured shape so that the stirrups of the saddle will hang in an opened out position to receive the boots of the rider, thus facilitating easier and more rapid mounting of the horse, and better foot retention of the stirrups during riding.

Broadly described, the stirrup setting device of the invention includes an elongated rod which has a pair of stirrup engaging members at opposite ends of the rod. The stirrup engaging members are open at one side to permit a part of the stirrup to be inserted in the interior of the stirrup engaging member. The member can assume a generally circular configuration, or can be triangularly shaped or rectangularly shaped. Whatever the shape of the stirrup retaining member, it has a bight or web portion which is offset from the longitudinal axis of the rod by which the stirrup engaging device members are interconnected. The offset between the web or bight portion of each stirrup engaging member from the axis of the elongated rod is approximately the width of the stirrup (stirrup width as used herein means the dimension of the stirrup as measured transversely thereacross in the direction that the foot or boot of the rider moves when it is inserted in the stirrup).

In use, the stirrup setting device of the invention is extended between the stirrups while they are suspended freely from the saddle. The stirrups are each twisted on their suspending strips, and one side portion of each stirrup is placed in a stirrup engaging element at one end of the rod. The twist which has been imparted to the strap by which the stirrup is suspended from the saddle is such that, in tending to return to a state of relaxation, the strap twists the stirrup to a position where one side of the stirrup is against the rod, and the other against the bight or web portion of the stirrup engaging element. When the stirrup is in this position, it extends approximately in a plane which itself extends normal to the fore and aft axis of the saddle. When the stirrups have been retained in this position for a substantial period of time, the straps by which the stirrups are suspended take on a set in their twisted configuration, thus tending to hold the stirrups in the position to which they have been twisted before the stirrup setting device is removed. After the stirrup setting device has been removed, a rider can then mount the saddle and use it during riding, without concern for the stirrup being twisted so that it is not readily engageable with the boot, or is not easily retained by the rider at all times during riding.

An important object of the invention is to provide a simply constructed, mechanically rugged and durable device which can be used to retain the stirrups of a saddle in a twisted orientation and thereby impart a permanent set to the straps or stirrup leathers by which the stirrups are supported, thus locating them in a position optimum for mounting and riding.

A further object of the invention is to provide a stirrup setting device which can be easily understood and used by any equestrian who wishes to set the stirrups of the saddle which is to be utilized in a way making the stirrups more easily utilized during mounting and riding.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
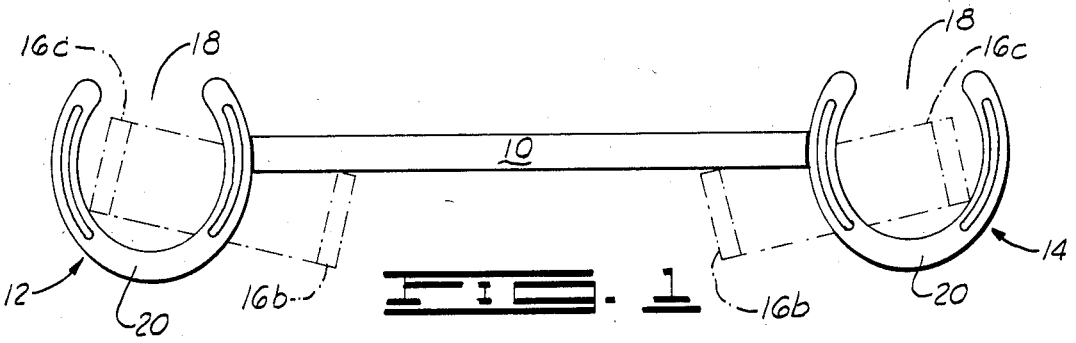
FIG. 1 is a plan view of the stirrup setting device of the invention and further illustrating in dashed lines the positions in which the stirrups are held when the device is in use.
Figure 2:
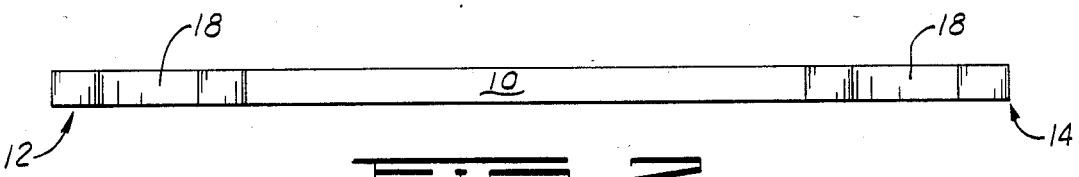
FIG. 2 is a side elevation view of the stirrup setting device.

A stirrup setting device of the invention includes an elongated rod or bar 10 which has secured to the opposite ends thereof, a pair of open sided stirrup engaging elements 12 and 14. For aesthetic purposes, the particular preferred form of these stirrup engaging elements, as illustrated in FIG. 1, is a horseshoe configuration. In order to permit the stirrups 16 (shown in FIG. 3) to be placed in the stirrup engaging elements 12 and 14 in a position hereinafter described, each of the stirrup engaging elements has an opening 18 formed at one side thereof. Each of the stirrup engaging elements 12 and 14 also has a bight or web portion 20 which is laterally offset from the longitudinal axis of the rod or bar 10. The bight or web portion 20 can be of any configuration, provided it serves as a stop or retainer against which one side of the rigid stirrup 16 bears when the stirrup is positioned as shown in FIGS. 1 and 3.

Figure 3:
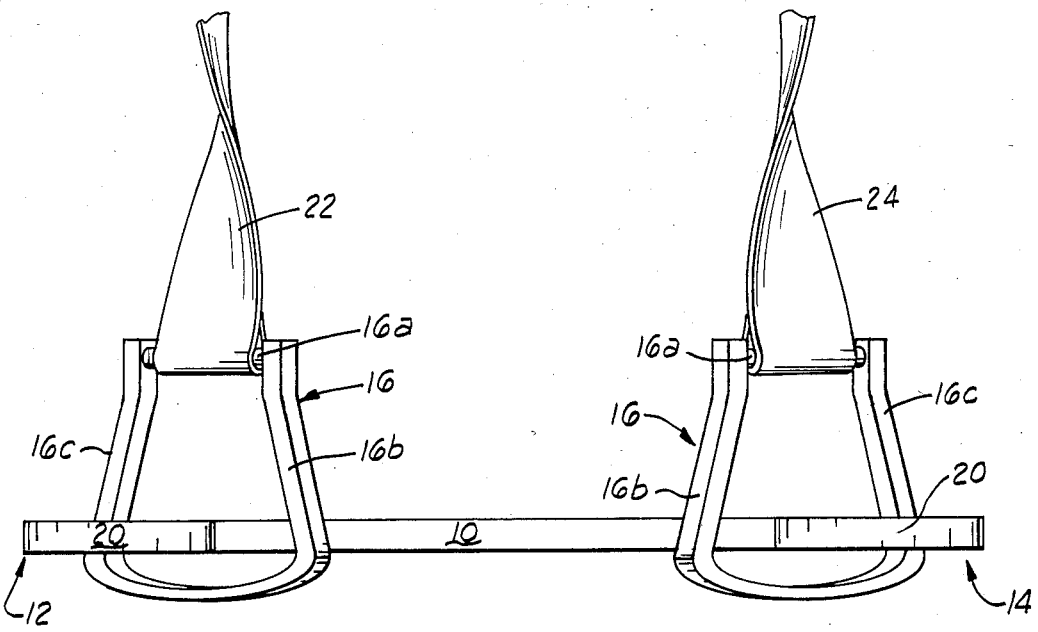
FIG. 3 is a view of the stirrup setting device similar to that shown in FIG. 1, but further illustrating the manner in which the stirrup setting device is used to impart a set twist to the other straps by which the stirrups are suspended, so that the stirrups will hang in a more acceptable position for mounting and riding the horse when the saddle is placed in use.

In referring to FIGS. 1 and 3, it will be noted that the straps or "stirrup leathers" 22 and 24, which support the pair of stirrups 16 in a suspended position from the saddle, have been twisted through an angle of substantially 90° from their usual relaxed position. The usual position of the straps 22 and 24, in conventional saddle manufacture, is to hang straight down from the saddle, and for each to engage a stirrup bar **16*a* of the stirrup 16 in a loop formed at the bottom end of the strap. When these straps are in their relaxed untwisted position, as the saddle normally is manufactured, the stirrups 16 extend substantially parallel to the fore and aft axis of the saddle. This orientation of the stirrups 16**, however, presents an inconvenience of the rider, since it is difficult to quickly place the toes of the boots of the rider in the stirrups when they extend parallel to the sides of the horse.

Further, after mounting the horse, the normal attitude of the rider, and the position his boots assume in the stirrups, require that the stirrups be twisted outwardly so that they are oriented at 90° to their normal relaxed position. If the rider loses a stirrup in the course of riding, the stirrup swings inwardly and extends parallel to the side of the horse, or stated differently, parallel to the fore and aft axis of the saddle. In this attitude, the stirrup presents some difficulty to the rider in turning the stirrup outwardly adequately to permit the toe of the boot to be reinserted in the stirrup.

In the use of the present invention, the straps 22 and 24 are twisted through 90° so that each of the stirrups 16 supported thereby lies approximately in a plane which extends normal to the fore and aft axis of the saddle. Stated differently, the stirrups 16 are oriented at about 90° from their usual position or attitude assumed when the straps 22 and 24 by which they are supported are untwisted and relaxed. The twisting of the straps 22 and 24 and setting of the stirrups 16 in the outwardly facing position shown in FIGS. 1 and 3 is achieved by placing the stirrup setting device in engagement with the two stirrups after the straps have been twisted in the manner described. The tension in the straps when twisted tends to torque or turn the stirrups 16 so that one side **16*b* of each stirrup bears against the back side of the elongated bar or rod 10. The tendency of its supporting strap to return to a relaxed position forces the opposite side 16*c* of each stirrup against the bight or web 20 of the respective stirrup engaging element 12 or 14**.

After the stirrup setting device has been in use to hold the stirrups in the position illustrated in FIGS. 1 and 3 over an extended period of time while the saddle is not in use, the straps tend to become set or fixed in their twisted status, and thereby hold the stirrups turned outwardly so that the openings in the stirrups are readily accessible to the rider, and no difficulty is encountered in inserting the toes of the boots into the stirrups. Moreover, the stirrups are maintained in this outwardly turned attitude even during riding, and loss of one or both stirrups by the rider can be quickly remedied by reinserting the toe into the stirrup which always remains in an attitude to be accessible to the toe of the boot.

Although a preferred embodiment of the present invention has been herein illustrated, it will be understood that various changes can be made in the described stirrup setting device without departure from the basic principles which underlie the invention. For example, instead of using the somewhat oval shaped horseshoes as the stirrup engaging elements at opposite ends of the rod or bar 10, V-shaped elements could be utilized, or U-shaped elements, or even L-shaped elements in which one arm of the L is secured to the end of the rod and the other arm forms the bight or web against which one side of the stirrup bears when the strap supporting the stirrup is twisted in the manner hereinafter described.

All changes and innovations of this type which continue to rely on the basic principles of the invention, as herein discussed, are deemed to be circumscribed by the spirit and scope of the invention, except as the same may be necessarily limited by the appended claims or reasonable equivalents thereof.

What is claimed is:

1. A saddle stirrup setting device comprising:

an elongated rod: and a pair of open-sided stirrup engaging elements secured to opposite ends of said elongated rod, and each including a stirrup stop web portion offset from the longitudinal axis of the rod and cooperating with the rod to retain a stirrup with one one side bearing against the rod, and an opposite side bearing against the web portion in an open riding attitude in which the open face of the stirrup extends substantially parallel to the axis of the rod, said web portion being offset from the axis of said elongated rod by a distance which is substantially equal to the transverse width of the stirrup to be set.

2. A saddle stirrup setting device as defined in claim 1 wherein each of said stirrup engaging elements is of oval horseshoe-shaped configuration.

3. The method of setting stirrups to facilitate mounting a saddled horse comprising:

extending in a horizontal direction beneath the center of the saddle, an elongated rod having a pair of open-sided stirrup engaging elements secured to its opposite ends, each of said stirrup-engaging elements further including a stirrup stop web portion offset from the longitudinal axis of the rod, with said web portions lying in substantially a common horizontal plane with each other and with the rod; and twisting the stirrups through about 90° and inserting each stirrup into the open side of one of said stirrup engaging elements so that when the twisting torque on each of said stirrups is released, the respective stirrup is retained by the respective stirrup engaging element with one side thereof bearing against the rod, and one side thereof bearing against the web portion of the respective open-sided stirrup engaging element, so that each stirrup is retained in an open riding attitude in which the open face of the stirrup extends generally parallel to the axis of the rod, thus facilitating mounting of the saddle horse.

4. An equestrian aid assembly for making saddle stirrups easier and more effective to use comprising:

a saddle;

a pair of leathers hanging vertically downwardly from opposite sides of the saddle;

a stirrup hanging from the lower end of each of said leathers; and a stirrup setting device extending substantially horizontally between the two stirrups and across beneath the saddle, said setting device including:

an elongated, substantially horizontally extending rod; and a stirrup engaging element secured to each end of said rod, each of said stirrup engaging elements including an open side open to facilitate insertion of a part of the stirrup therethrough, and a stirrup stop web portion horizontally offset from the longitudinal axis of the rod, and lying in a common horizontal plane with the rod, said stirrup stop web portions cooperating with the rod to receive and to retain a stirrup having one side bearing against the rod and one side bearing against the web portion in an open riding attitude in which the open face of the stirrup extends substantially parallel to the axis of the rod.

* * * * *